US011142940B2

(12) United States Patent
Aoshima

(10) Patent No.: US 11,142,940 B2
(45) Date of Patent: Oct. 12, 2021

(54) OPEN-CLOSE BODY CONTROLLER AND MOTOR

(71) Applicant: DENSO CORPORATION, Kariya (JP)

(72) Inventor: Hiroki Aoshima, Kariya (JP)

(73) Assignee: DENSO CORPORATION, Kariya (JP)

( * ) Notice: Subject to any disclaimer, the term of this patent is extended or adjusted under 35 U.S.C. 154(b) by 84 days.

(21) Appl. No.: 16/668,375

(22) Filed: Oct. 30, 2019

(65) Prior Publication Data

US 2020/0149340 A1 May 14, 2020

(30) Foreign Application Priority Data

Nov. 8, 2018 (JP) ..... JP2018-210493

(51) Int. Cl.
*E05F 15/00* (2015.01)
*E05F 15/695* (2015.01)

(52) U.S. Cl.
CPC ..... *E05F 15/695* (2015.01); *E05Y 2400/342* (2013.01); *E05Y 2400/51* (2013.01); *E05Y 2900/55* (2013.01)

(58) Field of Classification Search
CPC ..... E05F 15/41; E05F 15/689; E05F 15/695; E05F 15/60; E05Y 2800/41; E05Y 2900/55; E05Y 2400/564; E05Y 2400/36; E05Y 2400/315; E05Y 2400/309; E05Y 2400/51; E05Y 2400/342
USPC ..... 49/31, 26, 28; 318/455, 433, 62; 180/446
See application file for complete search history.

(56) References Cited

U.S. PATENT DOCUMENTS 5,422,551 A * 6/1995 Takeda ..... H02H 7/0851 318/265
5,774,046 A * 6/1998 Ishihara ..... B60J 1/17 318/257
10,815,302 B2 * 10/2020 Chen ..... A61P 35/00
10,815,714 B2 * 10/2020 Aoshima ..... E05F 15/689
(Continued)

FOREIGN PATENT DOCUMENTS

JP 2002-295128 A 10/2002
JP 2010-24646 A 2/2010
JP 2012-167433 A 9/2012

*Primary Examiner* — Chi Q Nguyen
(74) *Attorney, Agent, or Firm* — Oliff PLC

(57) ABSTRACT

An open-close body controller includes a motor, movement interference determination unit, and disturbance determination unit. Motor is configured to open and close an open-close body of vehicle. Movement interference determination unit is configured to detect whether characteristic value of motor, which is varied in accordance with change in load applied to open-close body when moving, is in movement interference range or non-movement interference range bordering threshold value and determine that movement of open-close body has been interfered with by foreign object when characteristic value is in movement interference range. Disturbance determination unit is configured to determine whether motor is subject to effect of disturbance. Movement interference determination unit is configured to correct threshold value to narrow movement interference range based on varied amount of rotation amount of motor that corresponds to movement distance of open-close body when disturbance determination unit determines motor is subject to effect of disturbance.

5 Claims, 5 Drawing Sheets

(56) References Cited

U.S. PATENT DOCUMENTS

| | | | | |
|---|---|---|---|---|
| 10,883,302 | B2 * | 1/2021 | Sugiyama | H02P 7/05 |
| 2011/0031919 | A1 * | 2/2011 | Green | H02P 21/06 318/432 |
| 2011/0210755 | A1 * | 9/2011 | Ogawa | E05F 15/46 324/686 |
| 2012/0209477 | A1 * | 8/2012 | Ono | E05F 15/70 701/49 |
| 2014/0054103 | A1 * | 2/2014 | Kezobo | G01R 31/343 180/446 |
| 2017/0247927 | A1 * | 8/2017 | Elie | E05F 15/611 |
| 2019/0085611 | A1 * | 3/2019 | Shibata | E05F 15/60 |
| 2019/0352954 | A1 * | 11/2019 | Salter | E05B 81/77 |

* cited by examiner

OPEN-CLOSE BODY CONTROLLER AND MOTOR

BACKGROUND

1. Field

The present disclosure relates to an open-close body controller for a vehicle and a motor.

2. Description of Related Art

A known open-close body controller that controls an open-close body such as a vehicle window includes a function for detecting that movement of the open-close body has been interfered with by a foreign object or the like. Japanese Laid-Open Patent Publication No. 2010-24646 discloses an example of an open-close body controller that detects that movement of a closing open-close body has been interfered with by a foreign object (open-close body has entrapped a foreign object) based on a characteristic value of a motor (e.g., rotation speed of motor), which is varied in accordance with changes in the load applied to the closing open-close body, to reverse or stop the action of the motor or the like and reduce the load applied to the foreign object.

In an open-close body controller such as that described above, wear increases backlash in a drive mechanism of the open-close body (wire type or X-arm type regulator when open-close body is vehicle window) that result in a tendency for the characteristic values of the motor to easily vary. This may lead to erroneous determination of movement interference of open-close body that particularly becomes an outstanding problem when the motor is subject to the effect of disturbance.

SUMMARY

It is an objective of the present disclosure to provide an open-close body controller and a motor that reduces erroneous determination of movement interference of open-close body.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

To achieve the above objective, an open-close body controller includes a motor, a movement interference determination unit, and a disturbance determination unit. The motor opens and closes an open-close body of a vehicle. The movement interference determination unit is configured to detect whether a characteristic value of the motor, which is varied in accordance with a change in a load applied to the open-close body when moving, is in a movement interference range or a non-movement interference range bordering a threshold value and determine that movement of the open-close body has been interfered with by a foreign object when the characteristic value is in the movement interference range. The disturbance determination unit is configured to determine whether the motor is subject to an effect of disturbance. The movement interference determination unit is configured to correct the threshold value so as to narrow the movement interference range based on a varied amount of a rotation amount of the motor that corresponds to a movement distance of the open-close body when the disturbance determination unit determines that the motor is subject to the effect of disturbance.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

First Embodiment

An open-close body controller and a motor in accordance with a first embodiment will now be described.

Figure 1:
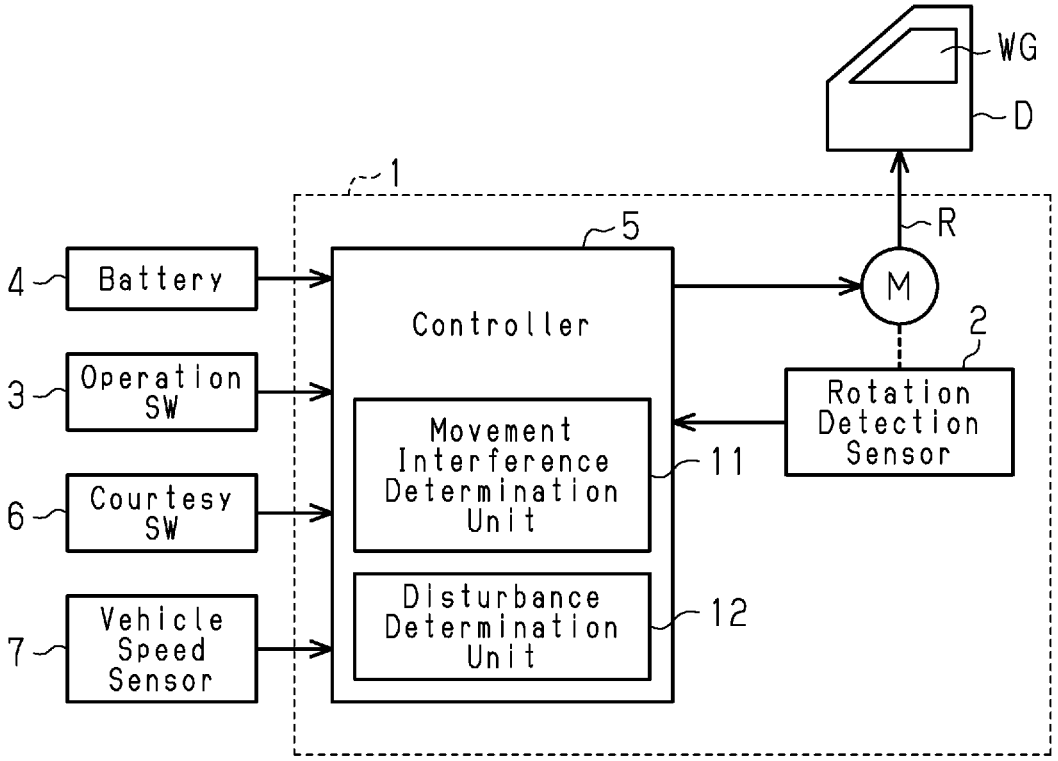
FIG. 1 is a schematic diagram of a power window device in accordance with first to third embodiments.

As shown in FIG. 1, a vehicle door D includes a window glass WG serving as an open-close body that is movable upward and downward. A motor M of a power window device 1 is drive-connected to the window glass WG by a wire type or X-arm type regulator R (drive mechanism). The motor M is arranged inside the vehicle door D.

The power window device 1 includes a rotation detection sensor 2, such as a Hall IC, and a controller 5 (open-close body controller). The rotation detection sensor 2 detects rotation of the motor M. The controller 5 supplies the motor M with power from a battery 4 based on a signal from the rotation detection sensor 2 and a signal from an operation switch 3. The controller 5 of the present embodiment is a power window ECU integrated with the motor M. The controller 5 may be configured as circuitry including 1) one or more processors that run on computer programs (software) to execute various processes, 2) one or more dedicated hardware circuits such as application-specific integrated circuits (ASICs) that execute at least some of the processes, or 3) a combination of processors and hardware circuits. The processors include a CPU and a memory such as a RAM and a ROM, and the memory stores program codes or instructions configured to have the CPU execute the processes. The memory, namely, a computer readable medium, includes any usable medium that is accessible by a versatile or dedicated computer.

When the operation switch 3, which is arranged on the vehicle door D, is operated, the controller 5 drives and controls the motor M to drive and open or close (move upward or downward) the window glass WG. The rotation detection sensor 2 outputs a pulse signal corresponding to the rotation of the motor M to the controller 5. The controller 5 executes various controls while checking the position and speed of the window glass WG from the input pulse signal to drive and control the motor M.

Further, the controller 5 is connected to an upper rank ECU (not shown) in a manner allowing for communication through a vehicle communication system. From the upper rank ECU, the controller 5 obtains a door open-close signal from a courtesy switch 6 that detects an open-close state of the vehicle door D, vehicle speed information from a vehicle speed sensor 7 installed in the vehicle, and the like.

The controller 5 includes a movement interference determination unit 11 and a disturbance determination unit 12.

The movement interference determination unit 11 determines whether movement of the window glass WG has been interfered with based on a characteristic value of the motor M that is varied in accordance with changes in the load applied to the moving window glass WG. In the present embodiment, the movement interference determination unit 11 compares an integrated amount of variations in the rotation speed of the motor M when closing the window glass WG with a threshold value T. When the integrated amount exceeds the threshold value T, the movement interference determination unit 11 determines that movement of the window glass WG has been interfered with, that is, the closing window glass WG has entrapped a foreign object. Based on the foreign object entrapment determination by the movement interference determination unit 11, the controller 5 drives and controls the motor M to stop or reverse movement of the window glass WG.

The disturbance determination unit 12 determines whether the motor M is subject to the effect of disturbance based on the vehicle information. In the present embodiment, the disturbance determination unit 12 determines that the motor M is subject to the effect of disturbance based on an ON signal of the door open-close signal from the courtesy switch 6 (signal indicating that vehicle door D is open). In further detail, when the door open-close signal goes ON (door open state), the disturbance determination unit 12 switches on a signal indicating disturbance (disturbance determination ON). Subsequently, when the door open-close signal goes off, the disturbance determination unit 12 switches off the signal indicating disturbance (disturbance determination OFF) when a set time (e.g., one second), which is set in advance, from when the signal is switched off elapses. Accordingly, the effect on the motor M of an impact produced when closing the vehicle door D is taken into consideration immediately after the courtesy switch 6 goes off (immediately after vehicle door D is closed).

The controller 5 is capable of checking the rotation amount of the motor M that corresponds to the movement distance of the window glass WG based on the pulse signal from the rotation detection sensor 2. In the present embodiment, the controller 5 detects a lock current when the window glass WG reaches an end position of a mechanical movable region (mechanical lock position at fully closed side or fully open side) and stores the rotation amount (the number of the pulse edges) of the motor M when detecting the lock current as a reference position. When wear increases backlash in a regulator R, the rotation amount of the motor M that is necessary for the window glass WG to reach the mechanical lock position increases. This varies the reference position. The controller 5 checks the varied amount of the reference position (hereafter referred to as the varied stroke amount).

When the disturbance determination unit 12 determines that the motor M is subject to the effect of disturbance, that is, when the disturbance determination, which is based on the door open-close signal, is ON, the movement interference determination unit 11 corrects the threshold value T based on the varied stroke amount.

Figure 2:
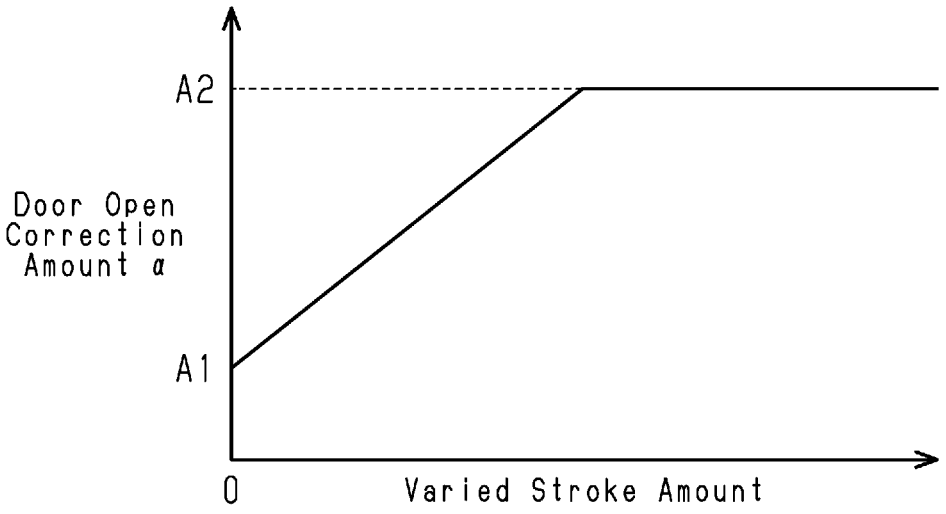
FIG. 2 is a diagram illustrating a process for setting a door open correction amount in the first embodiment.

FIG. 2 illustrates a process for setting a door open correction amount $\alpha$ corresponding to the varied stroke amount. The door open correction amount $\alpha$ is a correction amount added to a preset normal threshold value X (reference threshold value). When the varied stoke amount is zero, the movement interference determination unit 11 sets the door open correction amount $\alpha$ to an initial value A1. More specifically, even when there is no wear, the door open correction amount $\alpha$ (initial value A1) is added to the normal threshold value X as long as the disturbance determination based on the door open-close signal is ON. Further, as the varied stroke amount increases, the movement interference determination unit 11 sets the door open correction amount $\alpha$ to a larger value. When an upper limit value A2 is set for the door open correction amount $\alpha$, the door open correction amount $\alpha$ is set so as not to exceed the upper limit value A2.

A process for setting the threshold value T for movement interference determination will now be described.

Figure 3:
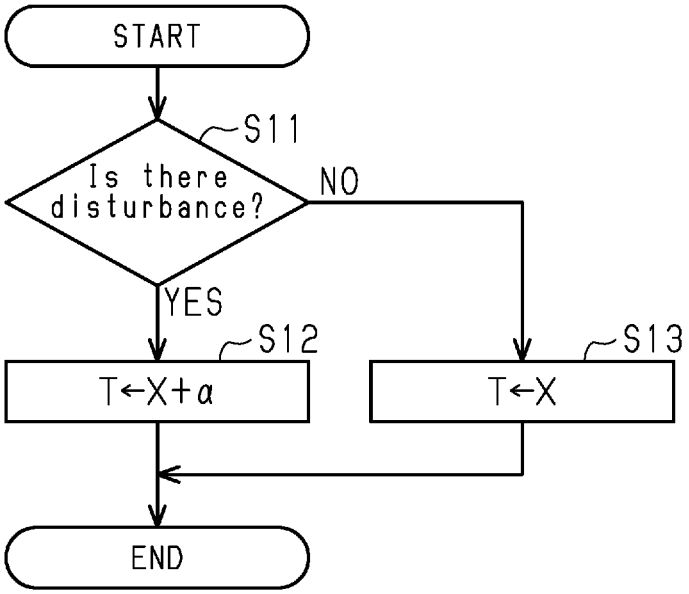
FIG. 3 is a flowchart illustrating a process for setting a threshold value in the first embodiment.

As shown in FIG. 3, the disturbance determination unit 12 determines whether the motor M is subject to the effect of disturbance based on the door-open close signal from the courtesy switch 6 when receiving a signal indicating that the operation switch 3 has been operated to close the window glass WG (step S11).

When determined that the motor M is subject to the effect of disturbance, the movement interference determination unit 11 sets the threshold value T to a value obtained by adding the door open correction amount $\alpha$ to the normal threshold value X (step S12). In this case, the movement interference determination unit 11 sets the door open correction amount $\alpha$ based on the varied stroke amount as described above (refer to FIG. 2).

When determined in step S11 that the motor M is not subject to the effect of disturbance, the movement interference determination unit 11 sets the normal threshold value X to the threshold value T (step S13).

The operation of the present embodiment will now be described.

When determined from the door open-close signal of the courtesy switch 6 that the motor M is subject to the effect of disturbance, the movement interference determination unit 11 corrects the threshold value T to increase. More specifically, the threshold value T is corrected so that a determination that movement of the window glass WG is being interfered with will less likely be given. This reduces the occurrence of an erroneous determination during movement interference determination that would be caused by the movement of the open vehicle door D or the impact produced when closing the vehicle door D. Further, the door open correction amount α is set based on the varied stroke amount. This allows for the setting of the threshold value T that is acceptable for a condition in which wear of the regulator R increases variation in the rotation speed of the motor M.

The advantages of the present embodiment will now be described.

(1) The movement interference determination unit 11 determines whether the characteristic value of the motor M (integrated amount of variations in rotation speed of motor M), which is varied in accordance with changes in the load applied to the closing window glass WG, has exceeded the threshold value T. More specifically, the movement interference determination unit 11 detects whether the characteristic value of the motor M is less than or equal to the threshold value T and included in a non-movement interference range or greater than the threshold value T and included in a movement interference range. The movement interference determination unit 11 determines that the closing movement of the window glass WG has been interfered with by a foreign object when the characteristic value of the motor M is in the movement interference range, that is, when the characteristic value of the motor M exceeds the threshold value T. When the disturbance determination unit 12 determines that the motor M is subject to the effect of disturbance, the movement interference determination unit 11 corrects the threshold value T to increase based on the varied amount of the rotation amount of the motor M (varied stroke amount) that corresponds to the movement distance of the window glass WG. More specifically, the movement interference determination unit 11 corrects the threshold value T to narrow the movement interference range. Increased backlash in the regulator R caused by wear varies the rotation amount of the motor M, which corresponds to the movement distance of the window glass WG. Thus, the threshold value T is corrected based on the varied amount of the rotation amount when the motor M is subject to the effect of disturbance. This reduces erroneous determination caused by wear during movement interference determination.

(2) The disturbance determination unit 12 determines that the motor M is subject to the effect of disturbance based on a signal indicating that the vehicle door D is open (ON signal of door open-close signal from courtesy switch 6). When the vehicle door D is open, opening and closing movements of the vehicle door D (particularly, impact when closing vehicle door D) will apply an external force to the motor M. Thus, the threshold value T can be corrected in an acceptable manner taking into consideration the effect that an opening or closing movement of the vehicle door D has on the characteristic value of the motor M (in the present embodiment, integrated amount of variations in rotation speed of motor M). As a result, erroneous determination of movement interference of the window glass WG is reduced in a preferred manner.

(3) When the disturbance determination unit 12 determines that the motor M is not subject to the effect of disturbance, the movement interference determination unit 11 sets the threshold value T, which is used for determination by the movement interference determination unit 11, to the normal threshold value X. In this case, the movement interference determination unit 11 does not correct the threshold value T to increase based on the varied amount of the rotation amount of the motor M (varied stroke amount), which corresponds to the movement distance of the window glass WG. In other words, the movement interference determination unit 11 does not perform a correction process that narrows the movement interference range. When the motor M is not subject to the effect of disturbance, the effect that wear has on the rotation speed of the motor M is small and erroneous determination of movement interference of the window glass WG will seldom occur even if the threshold value T is not corrected to be increased. Thus, when the motor M is not subject to the effect of disturbance, the threshold value T can be continuously set to the normal threshold value X without being corrected to be increased to accurately detect movement interference of the window glass WG.

Second Embodiment

An open-close body controller and a motor in accordance with a second embodiment will now be described. The control mode of the present embodiment is applied to the power window device 1 shown in FIG. 1 and differs from the first embodiment in the disturbance determination performed by the disturbance determination unit 12 and the process for setting the threshold value correction amount performed by the movement interference determination unit 11 based on the disturbance determination.

The disturbance determination unit 12 of the present embodiment determines that the motor M is subject to the effect of disturbance based on vehicle speed information from the vehicle speed sensor 7. More specifically, the disturbance determination unit 12 determines that the motor M is subject to the effect of disturbance when the vehicle speed V is greater than or equal to a preset threshold value Vt (e.g., 5 km/h).

The movement interference determination unit 11 sets a travel correction amount β corresponding to the varied stroke amount when the disturbance determination, which is performed by the disturbance determination unit 12 based on the vehicle speed information, is ON.

Figure 4:
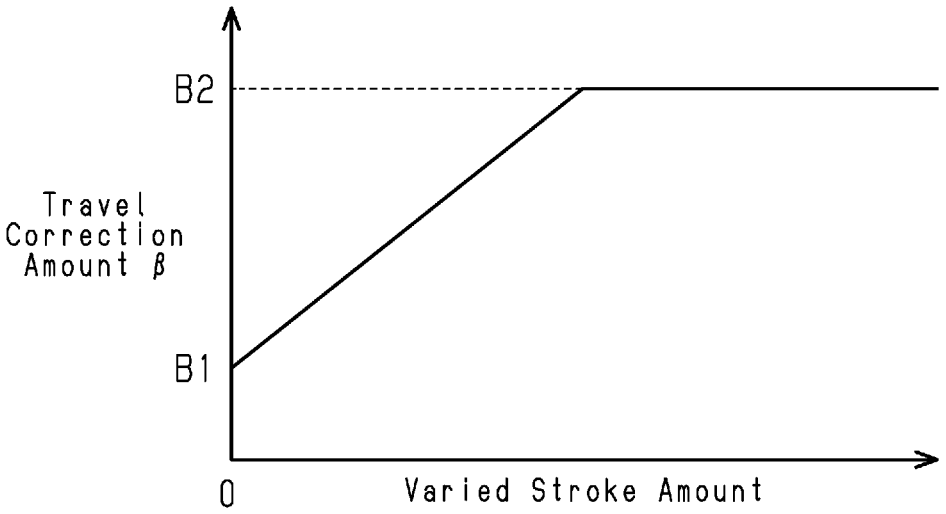
FIG. 4 is a diagram illustrating a process for setting a travel correction amount in the second embodiment.

FIG. 4 illustrates a process for setting the travel correction amount β corresponding to the varied stroke amount. The travel correction amount β is a correction amount added to the preset normal threshold value X (reference threshold value). When the varied stroke amount is zero, the movement interference determination unit 11 sets the travel correction amount β to an initial value B1. More specifically, even when there is no wear, the travel correction amount β (initial value B1) is added to the normal threshold value X as long as the disturbance determination, which is based on the vehicle speed information, is ON. Further, as the varied stroke amount increases, the movement interference determination unit 11 sets the travel correction amount β to a larger value. When an upper limit value B2 is set for the travel correction amount β, the travel correction amount β is set so as not to exceed the upper limit value B2.

A process for setting the threshold value T for movement interference determination in the present embodiment will now be described.

Figure 5:
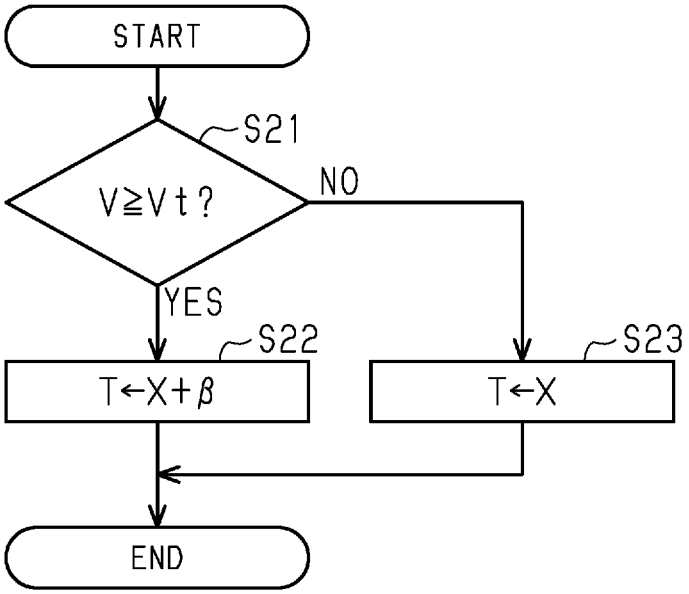
FIG. 5 is a flowchart illustrating a process for setting a threshold value in the second embodiment.

As shown in FIG. 5, the disturbance determination unit 12 determines whether the vehicle speed V, which is detected by the vehicle speed sensor 7, is greater than or equal to a threshold value Vt when receiving a signal indicating that the operation switch 3 has been operated to close the window glass WG (step S21).

When determined that the vehicle speed V is greater than or equal to the threshold value Vt, the movement interference determination unit 11 sets the threshold value T to a value obtained by adding the travel correction amount β to the normal threshold value X (step S22). In this case, the movement interference determination unit 11 sets the travel correction amount β based on the varied stroke amount (refer to FIG. 4).

When determined that the vehicle speed V is less than the threshold value Vt in step S21, the movement interference determination unit 11 sets the normal threshold value X to the threshold value T (step S23).

The advantages of the present embodiment will now be described.

When determined from the vehicle speed information of the vehicle speed sensor 7 that the motor M is subject to the effect of disturbance, the movement interference determination unit 11 corrects the threshold value T to increase. More specifically, the threshold value T is corrected so that a determination that movement of the window glass WG is being interfered with will less likely be given. This reduces the occurrence of an erroneous determination during movement interference determination that would be caused by vibration when the vehicle is traveling. Further, the travel correction amount β is set based on the varied stroke amount. This allows for the setting of the threshold value T that is acceptable for a condition in which wear of the regulator R increases variation in the rotation speed of the motor M.

Third Embodiment

An open-close body controller and a motor in accordance with a third embodiment will now be described. The control mode of the present embodiment is applied to the power window device 1 shown in FIG. 1 and differs from the first embodiment in the disturbance determination performed by the disturbance determination unit 12 and the process for setting the threshold value correction amount performed by the movement interference determination unit 11 based on the disturbance determination.

The disturbance determination unit 12 of the present embodiment determines whether the motor M is subject to the effect of disturbance based on whether the rotation speed of the motor M is stable, which is varied in accordance with the load applied to the closing window glass WG. For example, the disturbance determination unit 12 determines that the rotation speed of the motor M is unstable when the varied amount (inclination) of the rotation speed of the motor M per unit time exceeds a preset set amount.

The movement interference determination unit 11 sets an unstable condition correction amount γ corresponding to the varied stroke amount when the disturbance determination, which is performed by the disturbance determination unit 12 based on the rotation speed of the motor M, is ON.

Figure 6:
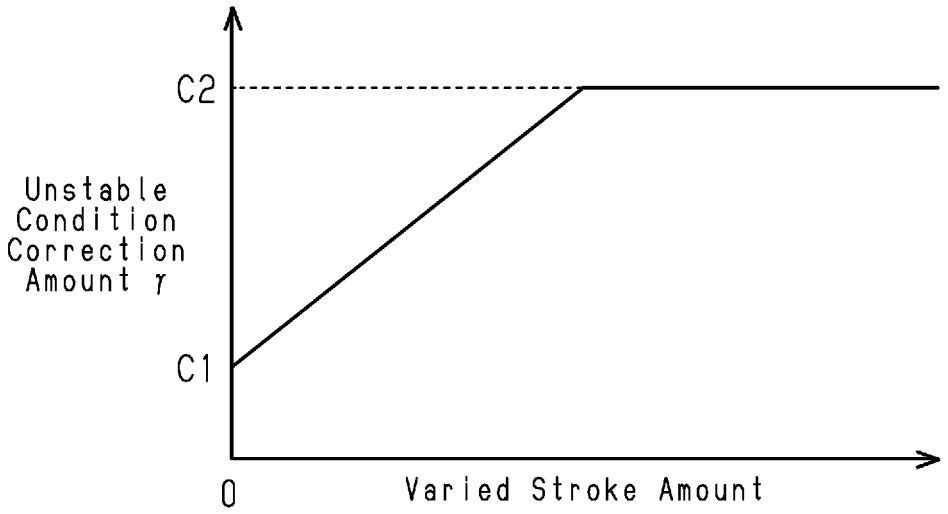
FIG. 6 is a diagram illustrating a process for setting an unstable condition correction amount in the third embodiment.

FIG. 6 illustrates a process for setting the unstable condition correction amount γ corresponding to the varied stroke amount. The unstable condition correction amount γ is a correction amount added to the preset normal threshold value X (reference threshold value). When the varied stroke amount is zero, the movement interference determination unit 11 sets the unstable condition correction amount γ to an initial value C1. More specifically, even when there is no wear, the unstable condition correction amount γ (initial value C1) is added to the normal threshold value X as long as the disturbance determination, which is based on the rotation speed of the motor M, is ON. Further, as the varied stroke amount increases, the movement interference determination unit 11 sets the unstable condition correction amount γ to a larger value. When an upper limit value C2 is set for the unstable condition correction amount γ, the unstable condition correction amount γ is set so as not to exceed the upper limit value C2.

A process for setting the threshold value T for movement interference determination in the present embodiment will now be described.

Figure 7:
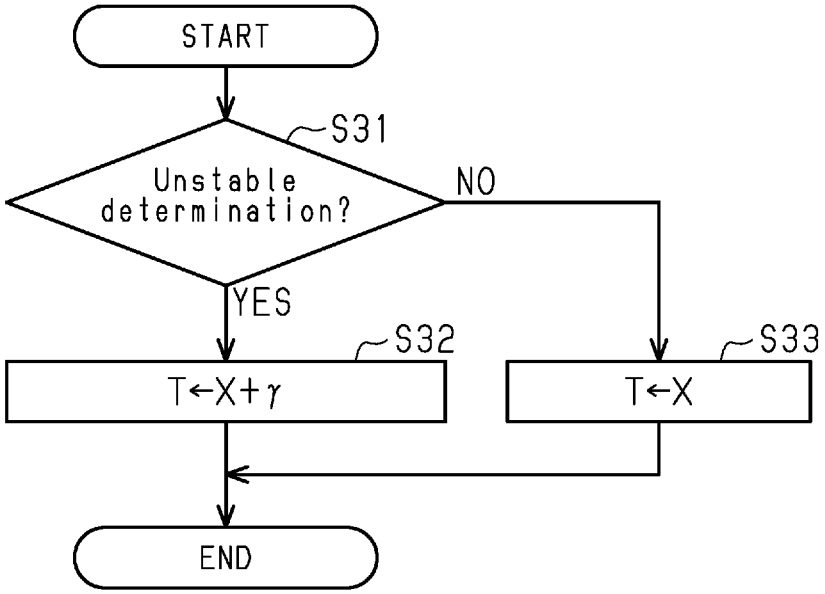
FIG. 7 is a flowchart illustrating a process for setting a threshold value in the third embodiment.

As shown in FIG. 7, the disturbance determination unit 12 determines whether the rotation speed of the motor M is unstable when receiving a signal indicating that the operation switch 3 has been operated to close the window glass WG (step S31).

When determined that the rotation speed of the motor M is unstable, the movement interference determination unit 11 sets the threshold value T to a value obtained by adding the unstable condition correction amount γ to the normal threshold value X (step S32). In this case, the movement interference determination unit 11 sets the unstable condition correction amount γ based on the varied stroke amount (refer to FIG. 6).

When determined in step S31 that the rotation speed of the motor M is unstable, the movement interference determination unit 11 sets the threshold value T to the normal threshold value X (step S33).

The advantages of the present embodiment will now be described.

When determined from a variation in the rotation speed of the motor M that the motor M is subject to the effect of disturbance, the movement interference determination unit 11 increases and corrects the threshold value T. More specifically, the threshold value T is corrected so that a determination that movement of the window glass WG is being interfered with will less likely be given. This reduces the occurrence of an erroneous determination that movement of the window glass WG is being interfered with under a situation in which the rotation speed of the motor M is unstable. Further, the unstable condition correction amount γ is set based on the varied stroke amount. This allows for the setting of the threshold value T that is acceptable for a condition in which wear of the regulator R increases variation in the rotation speed of the motor M.

The above embodiments may be modified as described below. The above-described embodiments and the modified examples described below may be combined as long as there is no technical contradiction.

The disturbance determination unit 12 may determine that the motor M is subject to the effect of disturbance based on the voltage applied to the motor M (e.g., when applied voltage is suddenly varied).

In each of the above embodiments, the integrated value of variations in the rotation speed of the motor M, which is varied in accordance with changes in the load applied to the moving window glass WG, is used as the characteristic value of the motor M. Instead, the value of the current supplied to the motor M may be used as the characteristic value. Further, the value of the rotation speed of the motor M may be used as the characteristic value of the motor M. In this case, the movement interference determination unit 11 compares the rotation speed of the motor M when closing the window glass WG with the threshold value T. When the rotation speed is less than the threshold value T, the movement interference determination unit 11 determines that movement of the window glass WG has been interfered with, that is, the closing window glass WG has entrapped a foreign object. More specifically, the movement interference determination unit 11 detects whether the rotation speed of the motor M is greater than or equal to the threshold value T and included in the non-movement interference range or less than the threshold value T and included in the movement interference range. When the rotation speed of the motor M is in the movement interference range (i.e., less than threshold value T), the movement interference determination unit 11 determines that the closing movement of the window glass WG has been interfered with by a foreign object.

A control mode for when using the value of the rotation speed of the motor M as the characteristic value of the motor M, for example in the first embodiment, will now be described with reference to FIGS. 8 and 9.

Figure 8:
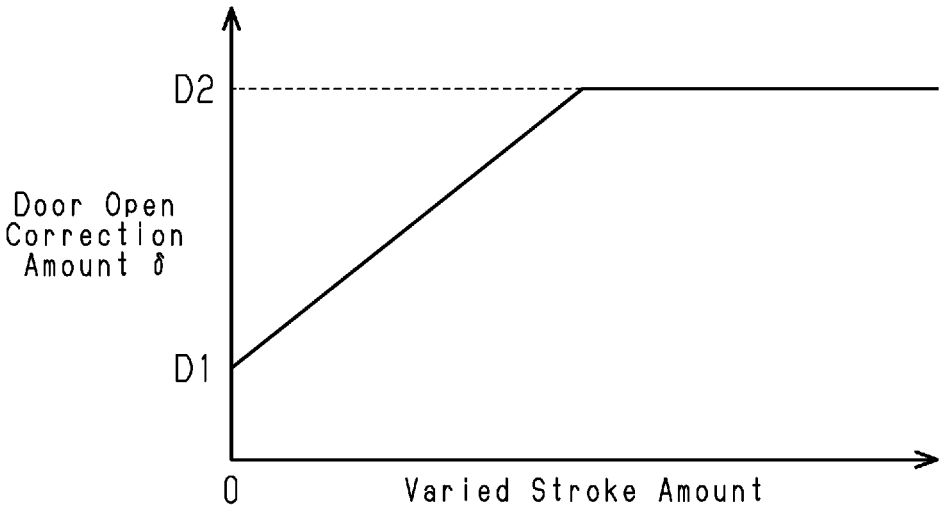
FIG. 8 is a diagram illustrating a process for setting a door open correction amount in a modified example.

FIG. 8 illustrates a process for setting a door open correction amount δ. The door open correction amount δ is a correction amount subtracted from the preset normal threshold value X (reference threshold value). When the varied stroke amount is zero, the movement interference determination unit 11 sets the door open correction amount δ to an initial value D1. More specifically, even when there is no wear, the door open correction amount δ (initial value D1) is subtracted from the normal threshold value X as long as the disturbance determination based on the door open-close signal is ON. Further, as the varied stroke amount increases, the movement interference determination unit 11 sets the door open correction amount δ to a larger value. When an upper limit value D2 is set for the door open correction amount δ, the door open correction amount δ is set so as not to exceed the upper limit value D2.

Figure 9:
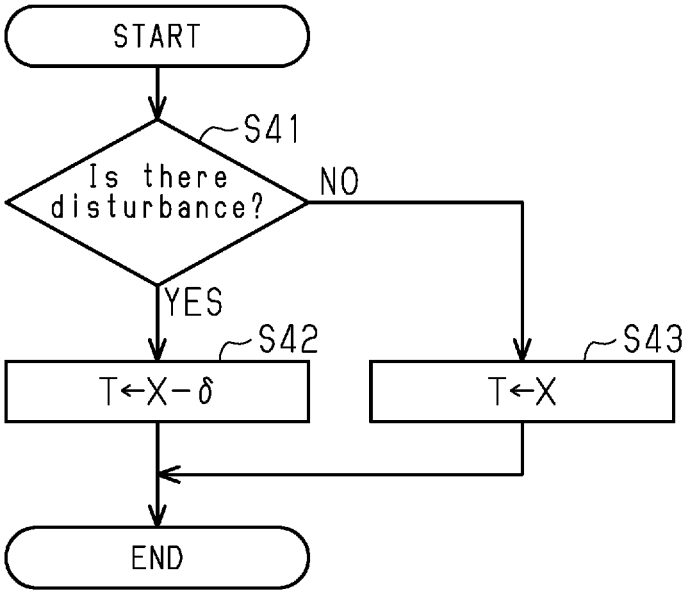
FIG. 9 is a flowchart illustrating a process for setting a threshold value in the same modified example.

As shown in FIG. 9, the disturbance determination unit 12 determines whether the motor M is subject to the effect of disturbance based on the door-open close signal from the courtesy switch 6 when receiving a signal indicating that the operation switch 3 has been operated to close the window glass WG (step S41).

When determined that the motor M is subject to the effect of disturbance, the movement interference determination unit 11 sets the threshold value T to a value obtained by subtracting the door open correction amount δ from the normal threshold value X (step S42). In this case, the movement interference determination unit 11 sets the door open correction amount δ based on the varied stroke amount as described above (refer to FIG. 8).

When determined in step S41 that the motor M is not subject to the effect of disturbance, the movement interference determination unit 11 sets the normal threshold value X to the threshold value T (step S43).

Such a mode also reduces erroneous determination in a preferred manner caused by wear during movement interference determination in the same manner as the first embodiment.

FIGS. 8 and 9 illustrate a case when the rotation value of the motor M is used as the characteristic value of the motor M in the first embodiment. Instead, the rotation speed of the motor M may be used as the characteristic value of the motor M in the second embodiment or the third embodiment.

In each of the above embodiments, the present disclosure is embodied in the determination of movement interference (entrapment of foreign object) when the window glass WG is closing but instead may be embodied in the determination of movement interference (entrapment of foreign object) when the window glass WG is opening.

In each of the above embodiments, the present disclosure is embodied in the power window device 1 of a vehicle but instead may be embodied in an open-close body drive device that drive and controls an open-close body other than the window glass WG of a vehicle (sunroof, sliding door, or the like).

A technical concept that can be recognized from the above embodiments and modified examples will now be described.

(A) An open-close body controller, wherein when the disturbance determination unit determines that the motor is not subject to the effect of disturbance, the movement interference determination unit is configured to set the threshold value, which is used for a determination given by the movement interference determination unit, to a preset normal threshold value without performing a correction process for narrowing the movement interference range based on a varied amount of a rotation amount of the motor that corresponds to a movement distance of the open-close body.

In the above-described aspect, when the motor is not subject to the effect of disturbance, the effect that wear has on the characteristic value of the motor M is small. Thus, erroneous determination of movement interference of the open-close body seldom occurs even if the correction process for narrowing the movement interference range is not performed. When the motor M is not subject to the effect of disturbance, the threshold value can be continuously set to the normal threshold value without undergoing the correction process for narrowing the movement interference range to accurately detect movement interference of the window glass.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. An open-close body controller comprising:

a motor that opens and closes an open-close body of a vehicle, the motor having a characteristic value that is varied in accordance with a change in a load applied to the open-close body when the open-close body is moving;

a movement interference determination unit configured to detect whether the characteristic value is in a movement interference range or a non-movement interference range bordering a threshold value, and determine that movement of the open-close body has been interfered with by a foreign object when the characteristic value is in the movement interference range; and a disturbance determination unit configured to determine whether the motor is subject to an effect of disturbance, wherein the movement interference determination unit is configured to correct the threshold value so as to narrow the movement interference range based on a varied amount of a rotation amount of the motor that corresponds to a movement distance of the open-close body when the disturbance determination unit determines that the motor is subject to the effect of disturbance.

2. The open-close body controller according to claim 1, wherein the disturbance determination unit is configured to determine that the motor is subject to the effect of disturbance based on a signal indicating that a vehicle door is open.

3. The open-close body controller according to claim 1, wherein the disturbance determination unit is configured to determine that the motor is subject to the effect of disturbance based on a vehicle speed.

4. The open-close body controller according to claim 1, wherein the disturbance determination unit is configured to determine that the motor is subject to the effect of disturbance based on a variation of the characteristic value of the motor, which is varied in accordance with a change in a load applied to the open-close body that is moving.

5. A motor comprising:

the open-close body controller according to claim 1, wherein the motor is configured integrally with the open-close body controller.

* * * * *